US010017883B2

(12) United States Patent
Joo et al.

(10) Patent No.: US 10,017,883 B2
(45) Date of Patent: Jul. 10, 2018

(54) POLYESTER TIRE CORD WITH EXCELLENT DIMENSIONAL STABILITY AND METHOD FOR MANUFACTURING THE SAME

(71) Applicant: HYOSUNG CORPORATION, Seoul (KR)

(72) Inventors: Si-Hwan Joo, Sejong (KR); Hong-Un Kim, Guri-si (KR); Jin-Kyeong Park, Youngin-si (KR); Su-Yeon Hwang, Incheon (KR); Cheol Kim, Geumcheon-gu (KR)

(73) Assignee: HYOSUNG CORPORATION, Seoul (KR)

( * ) Notice: Subject to any disclaimer, the term of this patent is extended or adjusted under 35 U.S.C. 154(b) by 35 days.

(21) Appl. No.: 15/102,115

(22) PCT Filed: Jan. 13, 2015

(86) PCT No.: PCT/KR2015/000314

§ 371 (c)(1),
(2) Date: Jun. 6, 2016

(87) PCT Pub. No.: WO2015/108312

PCT Pub. Date: Jul. 23, 2015

(65) Prior Publication Data

US 2016/0312388 A1 Oct. 27, 2016

(30) Foreign Application Priority Data

Jan. 16, 2014 (KR) ..... 10-2014-0005644

(51) Int. Cl.

| | |
|---|---|
| ***D02G 3/48*** | (2006.01) |
| ***D02G 3/02*** | (2006.01) |
| ***D02G 3/36*** | (2006.01) |
| ***D01F 6/62*** | (2006.01) |
| ***D01H 13/28*** | (2006.01) |
| *D01D 5/16* | (2006.01) |

(52) U.S. Cl.
CPC ..... *D02G 3/48* (2013.01); *D01F 6/62* (2013.01); *D01H 13/28* (2013.01); *D02G 3/02* (2013.01); *D02G 3/36* (2013.01); *D01D 5/16* (2013.01)

(58) Field of Classification Search
CPC ... D02G 3/02; D02G 3/36; D02G 3/48; D01F 6/62
See application file for complete search history.

(56) References Cited

U.S. PATENT DOCUMENTS 5,067,538 A 11/1991 Nelson et al.
5,132,067 A 7/1992 Nelson et al.
(Continued)

FOREIGN PATENT DOCUMENTS

EP 0331501 B1 1/1993
JP H06294072 A 10/1994
(Continued)

OTHER PUBLICATIONS

International Search Report (with English translation) regarding PCT/KR2015/000314, dated Mar. 31, 2015.
Written Opinion regarding PCT/KR2015/000314, dated Mar. 31, 2015.

*Primary Examiner* — Shaun R Hurley
(74) *Attorney, Agent, or Firm* — Harness, Dickey & Pierce, PLC

(57) ABSTRACT

A polyester tire cord having improved dimensional stability and methods of manufacturing the polyester tire cord are provided. The method includes forming a discharge yarn, extruded while a polyester containing 85 mol % or more of ethylene terephthalate units is melted and passes through a nozzle; forming an undrawn yarn by spinning the discharged yarn; manufacturing a yarn by multistep drawing the undrawn yarn; plying the yarn by twisting; and dipping the plied yard in a dipping solution, and then drying, drawing,
(Continued)

and heat-setting the plied yarn before dipping the plied yarn in resorcinol-formaldehyde latex and again drying an heat-setting the plied yarn. An intermediate elongation of the formed polyester tire cord after vulcanization for 20 minutes at 170° C. is E2, an intermediate elongation of the polyester tire cord before vulcanization is E1, and a difference between E2 and E1 is ΔE. ΔE divided by E1 is 0.5 or less.

5 Claims, 1 Drawing Sheet

(56) References Cited

U.S. PATENT DOCUMENTS

| | | | | |
|---|---|---|---|---|
| 6,511,747 | B1 * | 1/2003 | Cho | B60C 9/0042 152/451 |
| 6,955,854 | B2 * | 10/2005 | Kwon | B60C 9/0042 428/364 |
| 2004/0265578 | A1 * | 12/2004 | Kwon | B60C 9/0042 428/364 |

FOREIGN PATENT DOCUMENTS

| | | | |
|---|---|---|---|
| KR | 100140229 | B1 | 7/1998 |
| KR | 100571214 | B1 | 4/2006 |
| KR | 101314226 | B1 | 10/2013 |

* cited by examiner

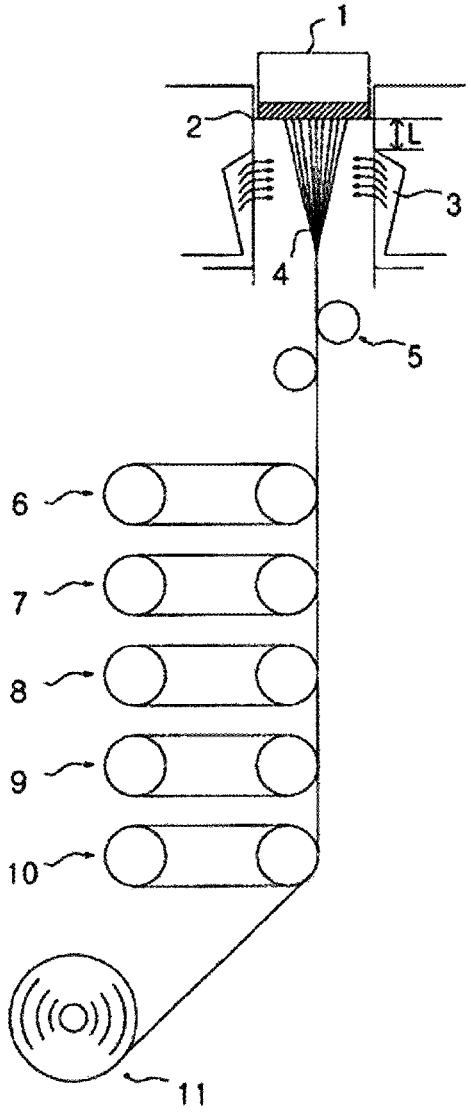
1
2
L
3
4
5
6
7
8
9
10
11

POLYESTER TIRE CORD WITH EXCELLENT DIMENSIONAL STABILITY AND METHOD FOR MANUFACTURING THE SAME

TECHNICAL FIELD

The present invention relates to a polyester tire cord with excellent dimensional stability which utilizes a yarn manufactured by adjusting spinning and drawing conditions, and a method for manufacturing the same.

BACKGROUND ART

High-strength polyester fiber is being variously used for industrial applications such as rubber reinforcing tire cord, seat belts, conveyor belts, V-belts and hoses. In particular, for fiber reinforcement of the tire, wherein latex-treated and heat-treated tire cords are applied, superior dimensional stability and tenacity are desired.

Conventionally, in order to increase the tenacity of the polyester fiber used for industrial purposes, the temperature of a high viscosity chip having intrinsic viscosity of 1.0 or more was sufficiently elevated to 300° C., so that the chip was melted and solidified. An undrawn yarn, which was produced by winding at the winding speed of 200 m/min or more in a Godet roller, was drawn by going through one or two stages and was allowed to relax.

However, in the method as described above, it was difficult to produce a yarn due to unwindability defects such as drawability decrease or filament fusing caused by increasing crystallinity.

Further, conventionally, in order to increase the tenacity of a polyester fiber used for industrial purposes, a method of manufacturing a yarn with a high draw ratio was used, but this method caused the problem that dimensional stability of a cord at a high temperature decreased and thus durability of the tire became lower, because of structural defects such as excess orientation and uneven length of the molecular chains of tie chain.

DISCLOSURE

Technical Problem

The present invention aims at providing a polyester tire cord with excellent dimensional stability and the method for manufacturing the same.

Technical Solution

The present invention provides a polyester tire cord with excellent dimensional stability, in which a polyester yarn undergoes twisting and dipping treatments, wherein intermediate elongation (@2.25 g/d) of the above-mentioned tire cord after vulcanization for 20 minutes at 170° C. is E2, and intermediate elongation (@2.25 g/d) of the tire cord before the above-mentioned vulcanization is E1, and ΔE divided by E1 is 0.5 or less, given that the difference between E2 and E1 is ΔE.

Here, the above-mentioned values of intermediate congregation are: 25° C., 60° C., 90° C., and 120° C., respectively.

Furthermore, a polyester yarn prior to the twisting treatment has inherent viscosity of 0.90 to 1.00, intermediate elongation (@4.5 g/d) of 6.5% or less, shrinkage of 2.0% or less, and E-S of not more than 8.0%.

Furthermore, the present invention provides a manufacturing method of a polyester tire cord having excellent dimensional stability which comprises the steps of: forming a discharged yarn extruded while a polyester containing 85 mol % or more of ethylene terephthalate units is melted and passed through the nozzle; forming an undrawn yarn by spinning the above-mentioned discharged yarn; manufacturing a yarn by multistep drawing the above-mentioned undrawn yarn by passing it through a draft roller so that the total draw ratio is 1.60 or less; weaving the above-mentioned yarn by cable/ply twisting at 300~500 twist/meter; and dipping the above-mentioned undrawn yarn, which is woven by undergoing the weaving step as described above, in a dipping solution of an epoxy and a pexul, and then drying and drawing and heat-setting it, before dipping it again in resorcinol-formaldehyde latex (RFL) and drying and heat-setting it.

Advantageous Effects

A tire cord which is manufactured by using the yarn produced in accordance with the present invention, is much improved in comparison with the conventional tire cord in terms of deterioration of physical properties which is caused by the temperature increase and demonstrates excellent heat resistance, thus when applied to actual tires, it shows excellent rolling resistance, which is expressed as a scale of performance evaluation of high performance tire. It also exhibits enhanced handling and high-speed durability, and excellent driving performance.

BRIEF DESCRIPTION OF THE DRAWINGS

FIG. 1 illustrates a spinning and drawing process of a polyester yarn according to the present invention.

DETAILED DESCRIPTION OF THE PREFERRED EMBODIMENTS

The present invention will be described in detail hereinafter.

A polyester tire cord with excellent dimensional stability according to the present invention, is characterized as follows: intermediate congregation (@2.25 g/d) of a tire cord after vulcanization for 20 minutes at 170° C. after twisting and dipping treatments of a polyester yarn is E2; intermediate congregation (@2.25 g/d) of the above-mentioned tire cord before vulcanization is E1 , and ΔE divided by E1 is 0.5 or less, given that the difference between E2 and E1 is ΔE.

Here, the above-mentioned values of intermediate congregation are: 25° C., 60° C., 90° C., and 120° C., respectively.

Furthermore, the polyester yarn prior to the above-mentioned twisting treatment, has inherent viscosity ranging from 0.90 to 1.00, intermediate congregation (@4.5 g/d) of 6.5% or less, shrinkage of 2.0% or less, and E-S of not more than 8.0%.

The manufacturing method of a polyester tire cord having excellent dimensional stability according to the present invention may comprise the steps of: forming a discharged yarn extruded while a polyester containing 85 mol % or more of ethylene terephthalate units is melted and passed through the nozzle; forming an undrawn yarn by spinning the above-mentioned discharged yarn; manufacturing a yarn by multistep drawing the above-mentioned undrawn yarn by passing it through a draft roller so that the total draw ratio is 1.60 or less; weaving the above-mentioned yarn by cable/ply twisting at 300~500 twist/meter; manufacturing a tire cord by dipping the above-mentioned undrawn yarn, which is woven by undergoing the weaving step as described above, in a dipping solution of an epoxy and a pexul, and then drying and drawing and heat-setting it, before dipping it again in resorcinol-formaldehyde latex (RFL) and drying and heat-setting it. But such method is not limited thereto.

The method for manufacturing a polyester tire cord according to the present invention will be described in detail as follows, with reference to FIG. 1.

First, a polyester containing 85 mol % or more of ethylene terephthalate units is melted and passed through the nozzle, and extruded to form a discharged yarn.

Meanwhile, the said polyester may contain an ethylene glycol and a terephthalic dicarboxylic acid or a derivative thereof, and a small amount of units in the form of copolymer units derived from one or more of ester-forming components.

Examples of ethylene terephthalate units and other copolymerizable ester-forming components include: a glycol such as 1,3-propanediol, 1,4-butanediol, 1,6-hexanediol; and a dicarboxylic acid such as terephthalic acid, isophthalic acid, hexahydro terephthalic acid, stilbene dicarboxylic acid, non-benzoic acid, adipic acid, sebacic acid, and azelaic acid.

A discharged yarn (4) is formed by extrusion of the polyester while passing it through the nozzle (2) after melting it, as described above.

Thereafter, the said discharged yarn (4) is passed through a cooling zone (3) to be rapidly solidified. Meanwhile, a heating device is installed within the distance from the start point of directly under the nozzle (2) to the cooling zone (3), that is, the section of the length (L) of the hood.

This zone is called a delay cooling zone or a heating zone, and this area has the length of 30~120 mm and the temperature of between 320° C. and 400° C. (temperature of the air contacting surface).

In the said cooling zone (3), depending on how you blow in the cooling air, open quenching method, circular closed quenching method, radial outflow quenching method, and radial inflow quenching method etc. can be applied, but is not limited thereto.

Here, the temperature of a cooling air to be injected into a cooling zone (3) for rapid cooling is adjusted to a range from to 50° C. The rapid cooling method that uses such abrupt temperature difference between the hood and the cooling zone (3), is aimed to increase the orientation of the undrawn yarn and to increase the formation of a link chain between crystal and crystal, by increasing the solidification point of a spun polymer and by increasing the spinning tension.

Thereafter, the discharged yarn (4) which is solidified while passing through a cooling zone (3), during which the friction coefficient between the broken yarn is reduced, may be oiled while having 0.5~1.2 weight%, to the discharged yarn, with the use of an emulsion applying device (5) wherein an emulsion with excellent drawability and excellent thermal efficiency is used.

The said undrawn yarn is formed by spinning a discharged yarn which has been oiled. Here, the spinning speed is preferably in a range from 3,500 to 4,500 m/min, but is not limited thereto.

Thereafter, a yarn is manufactured by multistep drawing the said undrawn yarn after passing it through a draft roller.

A thread that has passed through the first draft roller (6) in a spin draw method, undergoes a drawing process by passing through a series of draft rollers (7,8,9 and 10) while the total draw ratio stays at below 1.60, forming a yarn (11).

In a drawing process, an undrawn yarn may undergo a multistep drawing process in 1~4 stages, but it is preferable to give a heat treatment while each of the draft roller temperature is near the glass transition temperature of the undrawn yarn or below 95° C., and the draft roller (9) temperature is between 200 and 250° C.

When the temperature of the said draft roller (9) is below 200° C., crystallinity and size of the crystal cannot be increased. Therefore, tenacity and thermal stability of a yarn cannot be expressed. Thus, at high temperatures, shape stability is lowered. When the temperature of the last of the said draft roller (9) exceeds 250° C., there is the problem that tenacity of a yarn may be lowered, because of non-uniform microstructure of the yarn, for example, being too close to the melting point rather decomposing the crystal.

At this time, the winding speed of the drawn yarn is not particularly limited, but it is preferably in a range from 5,500 to 6,500 m/min. If the said winding speed is less than 5,500 m/min, productivity is reduced, and if the winding speed is more than 6,500 m/min, cutting occurs during winding and thus workability is reduced.

Preferably, a polyester yarn produced by the method as described above has intermediate elongation (@4.5 g/d) of 6.5% or less, shrinkage of 2.0% or less, and E-S of equal to or less than 8.0%. However, being outside of the above range unfavorably results in lowered shape stability, because tenacity is reduced at high temperatures and shrinkage is heightened.

Thereafter, by using a polyester yarn manufactured in the above process, a tire cord is produced after twisting, weaving, and dipping treatments.

First, a polyester yarn manufactured in the above process is woven by undergoing cable/ply twist drawing process at 300~500 twist/meter.

The said twisted yarn is manufactured by plying after the addition of ply twist and the addition of cable twist to the polyester yarn, and generally, both cable twist and ply twist have the same twist number (level of twist), or, if necessary, different twist numbers.

In the present invention, the twist number of the polyester tire cord is within the range of 300/300 TPM-500/500 TPM (Twist Per Meter), while the numerical values of cable and ply twist remain the same. If cable twist and ply twist have the same numerical value, the expression of physical properties of the manufactured tire cord can be maximized, since it is easier to maintain a straight line without exhibiting rotation or twisting. Here, when the twist number of cable/ply twist is less than 300/300 TPM, breaking elongation of the raw cord decreases and level of fatigue resistance becomes more likely to be decreased. And if it exceeds 500/500 TPM, decline in strength becomes too large, making it unsuitable to be used as a tire cord.

Later, a woven thread is deposited in a dipping solution of an epoxy and a pexul, thereafter being dried and drawn and heat-set, to be deposited again in resorcinol-formaldehyde latex (RFL), then dried and heat-set, producing a tire cord.

Here, in the said drying process, rapid handling at high temperatures must be avoided, and it is desirable to carry out the process for 180 to 220 seconds at the temperature ranging from 90 to 180° C. If the said drying temperature is less than 90° C., the drying process may not be sufficiently performed, and gel caused by a dipping solution resin during drying and heat treatments may occur. If the said drying temperature exceeds 180° C., due to rapid drying, gel caused by a dipping solution resin may occur and this may result in a non-uniform adhesion between the cord and the said dipping solution resin.

The said heat-setting process is carried out in order to obtain proper adhesion between a tire cord and a cord deposited in the said dipping solution resin. It is preferable that the above heat-setting process lasts 50 to 90 seconds at a temperature ranging from 220 to 250° C.

The tire cord produced as described above, is characterized as follows: intermediate elongation (@2.25 g/d) of the above-mentioned tire cord after vulcanization for 20 minutes at 170° C. is E2; intermediate elongation (@2.25 g/d) of the tire cord before the above-mentioned vulcanization is E1; and ΔE divided by E1 is 0.5 or less, given that the difference between E2 and E1 is ΔE.

Hereinafter, the present invention will be explained in detail by given examples. However, these examples are intended to illustrate the present invention in detail, and the scope of the present invention is not limited thereto.

EXAMPLES 1~3 AND COMPARATIVE EXAMPLE 1~2

A polyester chip for solid state polymerization containing 220 ppm of antimony metal, which has intrinsic viscosity (I.V.) of 1.10 and moisture content of 10 ppm, is manufactured. The manufactured chip is melt-spun with the use of a spinning draft as shown in the following table 1 through an extruder at a temperature of 290° C. Thereafter, the discharged yarn is solidified by passing through a heating zone (ambient temperature of 340° C.) having the length of 60 nm just below the nozzle, and after that, by passing through a cooling zone (20° C., blowing in cooling air at the wind speed of 0.5 m/s) having the length of 500 mm. And then, it is oiled with a solvent applied spinning solution (containing 70% of paraffin oil component). An undrawn yarn undergoes a winding process at the same spinning speed as in the following table 1, and the final yarn is manufactured by going through a winding process at a rate shown in table 1 after multistep drawing.

After manufacturing a cord yarn by cable/ply twisting the two manufactured yarns at 370 twist/meter, the said cord yarn is dipped into an adhesive solution of an epoxy resin and a pexul in a dipping tank. Thereafter, it is dried in a drying zone for 150 seconds at the temperature of 170° C. while undergoing 4.0% drawing process, and heat-set in a high temperature drawing zone for 150 seconds at the temperature of 245° C. while undergoing 3.0% drawing process, and it is once again dipped into resorcinol-formaldehyde latex (RFL) and dried for 100 seconds at the temperature of 170° C. Lastly, it is heat-set for 40 seconds at the temperature of 245° C. while undergoing 4.5% drawing process.

Evaluation Example 1

The physical properties of the drawn yarn, prepared in examples 1~3 and comparative examples 1 and 2, and of the tire cord are evaluated by the following methods, and the results are shown in table 1~4.

(1) Degree of Orientation

Measurements are made by the following method, with the use of a polarizing microscope equipped with a Berek compensator:

① putting a polarizer and an analyzer in a vertical position (orthogonal polarization).

② inserting a compensator into an analyzer so that it is arranged at an angle of 45 degrees (45° to the microscope's N—S direction).

③ placing a sample on the stage, so that it is arranged at a diagonal position (nY-direction: at a 45° angle with the polarizer). (A black compensation band appears at this location)

④ reading the scale at the point where the center of a sample is most darkened, while rotating to the right a micrometer screw of a compensator.

⑤ again, reading the scale at the point where the center of a sample is most darkened, while rotating again to the opposite direction.

⑥ calculating retardation (Y, nm) by dividing the difference between the above scales by 2, with reference to the table created by the manufacturing company.

⑦ deleting a compensator and an analyzer, and measuring the thickness of a sample (d, nm) with the use of an eyefilar micrometer.

⑧ retardation and thickness measured above are substituted into the following equation to determine birefringence (n) of a sample.

$$\Delta n = Y/d$$

(2) Strength (kgf) of a Drawn Yarn and a Tire Cord, and Intermediate Elongation (%)

After being allowed to stand for 24 hours at 25° C., 65% RH, slow elongation type tensile testing machine of Instrong Co. is utilized, and a tire cord can be measured by adding a twisting of 80 TPM (Twist Per Meter) to a drawn yarn, while the sample sheet is 250 mm, and the tensile speed is at 300 m/min.

(3) Dry Heat Shrinkage Ratio (%, Shrinkage)

After being allowed to stand for 24 hours at 25° C., 65% RH, dry heat shrinkage is measured by using the ratio between the length (L0) measured at a static load of 0.05 g/d and the length (L1) after treatment under a static load of 0.05 g/d for 2 minutes at 177° C.

$$S(\%) = (L0 - L1)/L0 \times 100$$

(4) E-S

Elongation under static load, in the present invention, is referred to as intermediate congregation (E), and (S) is intended to represent the dry heat shrinkage ratio of the above section (3). Further, E-S refers to a sum of intermediate elongation (E) and dry heat shrinkage ratio (S) in the present invention.

In general, when vulcanizing a tire, both shrinkage and intermediate elongation of a cord may change. A sum of shrinkage and intermediate elongation can be seen as similar to the concept of the modulus which a cord obtains after the complete manufacturing of a tire cord.

In other words, a correlation is formed wherein E-S decreases as modulus increases. That is, if modulus is high, the amount of force produced by tire deformation is large, making it easier to maneuver, whereas on the contrary, it is possible to produce the same degree of tension with less deformation, which allows for an evaluation that shape stability according to deformation is excellent. Therefore, E-S is to be utilized as an indicator of physical properties which is able to determine the excellence of the performance of a cord during tire manufacture.

Moreover, during tire manufacture, a tire with low E-S undergoes little deformation under heat, therefore has an effect of improved uniformity of a tire, and thus results in improved uniformity across the entire tire accordingly. Therefore, in case of a tire using a cord with low E-S, since there is an effect that uniformity of a tire is enhanced in comparison with the tire that uses a higher cord, it allows for improvement in tire performance.

E-S=intermediate elongation (elongation at specific load)+dry heat shrinkage (shrinkage)

(5) Intrinsic Viscosity (I.V.)

Phenol and 1,1,2,3-tetrachloro ethanol is dissolved for 90 minutes in a reagent (90r) mixed at a weight ratio of 6:4, such that a concentration of 0.1 g of a sample is 0.4 g/100 ml. After that, the resulting mixture is charged into an Ubbelohde viscometer, and maintained in a thermostat at 30° C. for 10 minutes. With the use of a viscometer and an aspirator, drops per second of the resulting solution is measured.

After drops per second of a solvent is also determined by the same method, relative viscosity (R.V.) and intrinsic viscosity (I.V.) are calculated by the following equations 1 and 2, respectively.

Relative viscosity (R.V.)=drops per second of a sample/drops per second of a solvent [Equation 1]

Intrinsic viscosity (I.V.)=¼×(R.V.-1)/concentration+¾×(ln R.V./concentration) [Equation 2]

(6) Degree of Crystallinity

Degree of crystallinity is measured with the use of a density gradient column by using a density method. Density of a crystalline region is $\rho_c$, density of a non-crystalline region is $\rho_a$, and given that density of a sample is p, crystallinity (X) is calculated by the following equation.

$$X(\%)=(\rho_c-\rho)/(\rho_c-\rho_a)\times 100$$

In the case of polyester, $\rho_c$=1.455 g/cm$^3$, and $\rho_a$=1.331 g/cm$^3$.

Evaluation Example 2

After 20 minutes of vulcanization at 170° C. of a tire cord produced in examples 1~3 and comparative examples 1 and 2, physical properties (strength, intermediate congregation, breaking elongation) are evaluated in the same manner as in evaluation example 1. The results are shown in table 5 below.

TABLE 1

<Spinning and drawing conditions>

| | Spinning speed (m/min) | Winding speed (m/min) | Draw ratio |
|---|---|---|---|
| Example 1 | 3900 | 6000 | 1.54 |
| Example 2 | 3950 | 6000 | 1.52 |
| Example 3 | 4000 | 6000 | 1.50 |
| Comparative Example 1 | 2800 | 6000 | 2.14 |
| Comparative Example 2 | 2850 | 6000 | 2.11 |

TABLE 2

<Physical properties of undrawn yarn>

| | Degree of orientation (Δn, ×10$^3$) | Density (g/cm$^3$) | Degree of crystallinity (%) |
|---|---|---|---|
| Example 1 | 70.0 | 1.3614 | 23.5 |
| Example 2 | 72.0 | 1.3628 | 24.7 |
| Example 3 | 75.0 | 1.3703 | 31.2 |
| Comparative Example 1 | 58.0 | 1.3484 | 12.0 |
| Comparative Example 2 | 62.1 | 1.3514 | 14.7 |

TABLE 3

<Physical properties of yarn>

| | Intrinsic viscosity (dl/g) | Denier | Strength (kg) | Tenacity (g/d) | Intermediate elongation (%, @4.5 g/d) | Breaking elongation (%) | Shrinkage (%) | E-S (%) |
|---|---|---|---|---|---|---|---|---|
| Example 1 | 0.93 | 1540 | 10.25 | 6.7 | 6.0 | 19.5 | 1.9 | 7.9 |
| Example 2 | 0.93 | 1540 | 10.00 | 6.5 | 6.2 | 20.2 | 1.6 | 7.8 |
| Example 3 | 0.93 | 1540 | 9.95 | 6.5 | 6.3 | 20.5 | 1.5 | 7.8 |
| Comparative Example 1 | 0.93 | 1540 | 13.60 | 8.8 | 5.0 | 11.1 | 5.5 | 10.5 |
| Comparative Example 2 | 0.93 | 1540 | 13.40 | 8.7 | 5.2 | 12.0 | 5.3 | 10.5 |

TABLE 4

<Physical properties of tire cord>

| | 25° C. | | | | |
|---|---|---|---|---|---|
| | Strength (kg) | Intermediate Elongation ($E(25)_1$, %, @2.5 g/d) | Breaking Elongation (%) | Shrinkage (%) | E-S (%) |
| Example 1 | 18.9 | 4.5 | 19.5 | 0.6 | 6.0 |
| Example 2 | 18.8 | 4.5 | 20.1 | 0.6 | 5.9 |
| Example 3 | 18.7 | 4.5 | 21.9 | 0.5 | 5.1 |
| Comparative example 1 | 23.3 | 4.0 | 15.1 | 2.0 | 5.1 |
| Comparative example 2 | 22.8 | 3.9 | 17.9 | 2.0 | 5.0 |

TABLE 4-continued

<Physical properties of tire cord>

| | 60° C. | | |
|---|---|---|---|
| | Strength (kg) | Intermediate Elongation ($E(25)_1$, %, @2.5 g/d) | Breaking Elongation (%) |
| Example 1 | 18.5 | 5.5 | 28.2 |
| Example 2 | 18.6 | 5.8 | 28.4 |
| Example 3 | 18.5 | 5.7 | 28.2 |
| Comparative example 1 | 21.2 | 4.9 | 15.8 |
| Comparative example 2 | 19.8 | 4.6 | 17.7 |

| | 90° C. | | |
|---|---|---|---|
| | Strength (kg) | Intermediate Elongation ($E(25)_1$, %, @2.5 g/d) | Breaking Elongation (%) |
| Example 1 | 17.3 | 6.6 | 28.6 |
| Example 2 | 17.4 | 6.6 | 29.8 |
| Example 3 | 17.2 | 6.5 | 30.1 |
| Comparative example 1 | 13.9 | 5.5 | 16.1 |
| Comparative example 2 | 17.7 | 4.9 | 15.1 |

| | 120° C. | | |
|---|---|---|---|
| | Strength (kg) | Intermediate Elongation ($E(25)_1$, %, @2.5 g/d) | Breaking Elongation (%) |
| Example 1 | 15.5 | 7.1 | 29.5 |
| Example 2 | 15.6 | 7.1 | 30.1 |
| Example 3 | 15.6 | 7.1 | 29.6 |
| Comparative example 1 | 15.2 | 6.0 | 14.4 |
| Comparative example 2 | 16.7 | 5.4 | 17.9 |

TABLE 5

<Physical properties of tire cord after 20 minutes of vulcanization at 170° C.>

| | 25° C. | | | |
|---|---|---|---|---|
| | Strength (kg) | Intermediate Elongation ($E(25)_2$ %, @2.5 g/d) | Breaking Elongation (%) | $E(25)/E(25)_1$ |
| Example 1 | 19.1 | 6.8 | 27.0 | 0.5 |
| Example 2 | 19.0 | 6.8 | 26.5 | 0.5 |
| Example 3 | 18.8 | 6.9 | 27.1 | 0.5 |
| Comparative example 1 | 22.8 | 8.0 | 20.1 | 1.0 |
| Comparative example 2 | 22.4 | 7.8 | 22.5 | 1.0 |

| | 60° C. | | | |
|---|---|---|---|---|
| | Strength (kg) | Intermediate Elongation ($E(25)_2$, %, @2.5 g/d) | Breaking Elongation (%) | $E(25)/E(25)_1$ |
| Example 1 | 18.5 | 7.3 | 28.2 | 0.3 |
| Example 2 | 18.4 | 7.4 | 29.1 | 0.3 |
| Example 3 | 18.3 | 7.6 | 29.3 | 0.3 |
| Comparative example 1 | 20.2 | 9.1 | 21.3 | 0.9 |
| Comparative example 2 | 19.3 | 8.5 | 21.4 | 0.8 |

TABLE 5-continued

<Physical properties of tire cord after 20 minutes of vulcanization at 170° C.>

| | 90° C. | | | |
|---|---|---|---|---|
| | Strength (kg) | Intermediate Elongation ($E(25)_2$, %, @2.5 g/d) | Breaking Elongation (%) | $E(25)/E(25)_1$ |
| Example 1 | 16.9 | 8.3 | 30.1 | 0.3 |
| Example 2 | 16.7 | 8.4 | 31.2 | 0.3 |
| Example 3 | 16.6 | 8.3 | 30.9 | 0.3 |
| Comparative example 1 | 18.2 | 9.9 | 19.3 | 0.8 |
| Comparative example 2 | 17.6 | 9.0 | 20.5 | 0.8 |

| | 120° C. | | | |
|---|---|---|---|---|
| | Strength (kg) | Intermediate Elongation ($E(25)_2$, %, @2.5 g/d) | Breaking Elongation (%) | $E(25)/E(25)_1$ |
| Example 1 | 16.0 | 8.9 | 27.5 | 0.3 |
| Example 2 | 15.9 | 9.0 | 28.1 | 0.3 |
| Example 3 | 15.8 | 9.0 | 28.0 | 0.3 |
| Comparative example 1 | 16.5 | 10.7 | 18.5 | 0.8 |
| Comparative example 2 | 16.1 | 9.5 | 21.6 | 0.8 |

As can be seen from Table 5, shape stability (E-S) and intermediate elongation of a tire cord manufactured in examples 1~3 are excellent in comparison with those of a tire cord manufactured in comparative example 1, and it has been demonstrated that a tire cord manufactured in examples 1~3 is a product with excellent dimensional stability since the proportion of the high temperature modulus difference (the difference between intermediate elongation before and after vulcanization) shows a superb value of 0.5.

DESCRIPTION OF THE CODES

1: Pack
2: Nozzle
3: Cooling zone
4: Discharged yarn
5: Emulsion imparting device
6: Drawing roller GR1
7: Drawing roller GR2
8 : Drawing roller GR3
9: Drawing roller GR4
10: Drawing roller GR5
11: Yarn
L: Length of the hood

The invention claimed is:

1. A manufacturing method of a polyester tire cord having dimensional stability, the method comprising the steps of:

forming a discharged yarn extruded while a polyester containing 85 mol % or more of ethylene terephthalate units is melted and passed through a nozzle;

forming an undrawn yarn by spinning the discharged yarn;

manufacturing a yarn by multistep drawing the undrawn yarn by passing the yarn through a plurality of draft rollers so that a total draw ratio is 1.60 or less, wherein at least one draft roller of the plurality of draft rollers has a temperature between 200° C. and 250° C. and the remaining draft rollers of the plurality of draft rollers have temperatures less than 95° C.;

plying the yarn by cable / ply twisting at 300~500 twist/meter; and dipping the plied yarn, in a dipping solution of an epoxy and a pexul, and then drying, drawing, and heat-setting the plied yarn, before dipping the plied yarn in resorcinol-formaldehyde latex (RFL) and again drying and heat-setting the plied yarn.

2. The manufacturing method of claim 1, wherein the yarn prior to plying has an inherent viscosity of 0.90 to 1.00, an intermediate elongation (@4.5 g/d) of 6.5% or less, a shrinkage of 2.0% or less, and a sum of intermediate elongation and dry heat shrinkage ratio (E-S) of not more than 8.0%.

3. The manufacturing method of claim 1, wherein following the dipping treatments, an intermediate elongation (@2.25 g/d) of the polyester tire cord after vulcanization for 20 minutes at 170° C. is E2 , an intermediate elongation (@2.25 g/d) of the polyester tire cord before vulcanization is E1 , and a difference between E2 and E1 is ΔE, comprises: ΔE divided by E1 is 0.5 or less.

4. The manufacturing method of claim 1, wherein E2 and E1 are each measured at 25° C., 60° C., 90° C., and 120° C.

5. A polyester tire cord produced according to the manufacturing method of claim 1.

* * * * *